US005457142A

United States Patent [19]

Dando et al.

[11] Patent Number: 5,457,142

[45] Date of Patent: Oct. 10, 1995

[54] HOT-BOX FOUNDRY MIX

[75] Inventors: Thomas E. Dando, Sunbury, Ohio; Gary W. Strehl, Midland, Mich.

[73] Assignee: Ashland Inc., Columbus, Ohio

[21] Appl. No.: 47,439

[22] Filed: Apr. 13, 1993

[51] Int. Cl.[6] ..... B22C 1/18; C08K 3/26

[52] U.S. Cl. ..... 523/139; 523/145; 524/424; 524/425; 524/433; 524/456

[58] Field of Search ..... 523/139, 145; 524/424, 425, 433, 456

[56] References Cited

U.S. PATENT DOCUMENTS

| | | | |
|---|---|---|---|
| 3,306,864 | 6/1967 | Lang | 523/145 |
| 3,472,429 | 10/1969 | Hayford | 222/610 |
| 4,600,733 | 7/1986 | Ohashi | 523/144 |
| 4,766,949 | 8/1988 | Jhaveri | 164/526 |
| 4,884,620 | 12/1989 | Jhaveri | 164/15 |

FOREIGN PATENT DOCUMENTS 4931178 of 1974 Japan .

*Primary Examiner*—Paul R. Michl
*Assistant Examiner*—John J. Guarriello
*Attorney, Agent, or Firm*—David L. Hedden

[57] ABSTRACT

This invention relates to a hot-box foundry mix. The hot-box foundry mix comprises (a) an aggregate (b) a thermosetting resin; (c) a latent acid curing catalyst; and (d) an effective benchlife extending amount of a compound selected from the group consisting of an alkaline earth metal carbonate, an alkaline earth metal oxide, and mixtures thereof. The hot-box foundry mixes are used to prepare foundry molds and cores. The foundry molds and cores are used to cast metals.

15 Claims, No Drawings

HOT-BOX FOUNDRY MIX

TECHNICAL FIELD

This invention relates to a hot-box foundry mix. The hot-box foundry mix comprises (a) a foundry aggregate (b) a thermoset resin; (c) a latent acid curing catalyst; and (d) an effective benchlife extending amount of a compound selected from the group consisting of an alkaline earth metal carbonate, oxide, or mixtures thereof. The hot-box foundry mixes are used to prepare foundry molds and cores. The foundry molds and cores are used to cast metals.

BACKGROUND

It is known that heat curable workable foundry molds and cores can be prepared by the so-called "hot-box" process. This process involves injecting a foundry mix consisting of a foundry aggregate containing a latent acid curing catalyst and a thermosetting resin into a heated corebox where it is allowed to harden into a workable foundry shape and then removed from the corebox.

The bench life of the foundry mix is the time period between forming the mixture of the aggregate and binder and the time when the mixture is no longer useful for making acceptable molds and cores. A measure of mold and core acceptability is tensile strength. If a foundry mix consisting of aggregate and binder composition is used after the bench life has expired, the resulting molds and cores will have insufficient tensile strength.

Since the foundry mix of a hot-box system consists of an aggregate containing a latent acid curing catalyst and a thermosetting resin, the catalyst and resin may react prior to shaping the mix into foundry molds and cores. If this reaction occurs, it will reduce the flowability of the foundry mix and the resulting molds and cores will have reduced strength. Additionally, it will be necessary to clean the hoppers, in which the foundry mix is stored, more frequently. This is time consuming and expensive.

Without a benchlife extender, it is difficult to store a hot-box foundry mix for even two hours before using it. Because is not always possible to use the foundry mixes immediately after mixing, it is desirable to prepare foundry mixes with an extended bench life.

SUMMARY OF THE INVENTION

The subject invention relates to hot-box foundry mixes comprising:

(1) a foundry aggregate;

(2) a thermosetting resin;

(3) a catalytically effective amount of a latent acid curing catalyst; and (4) an effective benchlife extending amount of a compound selected from the group consisting of an alkaline earth metal carbonate, alkaline earth metal oxide, or mixtures thereof.

The addition the alkaline earth metal carbonate or alkaline earth metal oxide to the foundry mix improves the benchlife of the foundry mix. Consequently, foundries can use the foundry mix after it has aged substantially and still make foundry molds and cores that have acceptable tensile strengths. Other aspects of the invention relate to the use of the foundry mixes to make foundry shapes which are used to cast metal parts.

BEST MODE AND OTHER MODES

For purposes of describing and claiming this invention, the term "foundry mix" comprises the foundry aggregate, thermosetting resin, benchlife extender, and latent acid catalyst as a mixture. The term "foundry shape" includes foundry molds and cores made by shaping the foundry mixes.

Thermosetting resins which are used in hot-box binder systems include phenol-formaldehyde resins, furfuryl alcohol resins, furfural-phenol resins, furfural-ketone resins, furfuryl alcohol-formaldehyde resins, furfuryl alcohol-urea-formaldehyde resins, furfuryl alcohol-phenol-formaldehyde resins, melamine-formaldehyde resins, urea-formaldehyde resins, resorcinol-formaldehyde resins, and the like.

Preferably used as the thermosetting resin are phenol-formaldehyde-urea resins prepared by the condensation of excess formaldehyde with phenol and urea in the presence of an alkali. See, for example U.S. Pat. No. 3,306,864, which is incorporated by reference into this disclosure. Preferably the thermosetting resin does not contain more than about 30 percent by weight water based upon the total weight of the thermosetting resin, most preferably about 15 to about 20 percent by weight. Most preferably the thermosetting resin contains less than 5% weight percent of free formaldehyde, most preferably less than 3% weight percent of free formaldehyde, said weight percent being based upon the total weight of the resin.

Thermosetting resins do not include novolak resins prepared by the acid catalyzed reaction of phenol and formaldehyde with excess phenol.

The resin is used in an effective binding amount. An effective binding amount is amount which will impart adequate tensile strengths to the foundry shapes when used in conjunction with the latent acid curing catalyst. Generally, an effective binding amount of the binder is from 0.5 weight percent to 15.0 weight percent, based upon the weight of the aggregate, usually from 1.0 weight percent to 5.0 weight percent of aggregate.

As was mentioned, the benchlife extenders are alkaline earth metal carbonates such as magnesium carbonate, calcium carbonate, and barium carbonate, and alkaline earth metal oxides such as magnesium oxide, calcium oxide, and barium oxide, preferably calcium carbonate. The particle size of the benchlife extender typically is from about 0.5 micron to about 25 microns, preferably from about 1 micron to about 10 microns. It has been found that the use of the benchlife extender in amounts of from 0.01 to 1.0 weight percent of the thermosetting resin, preferably 0.05 to 0.5 weight percent, most preferably 0.05 to 0.1 weight percent, are effective. Although more benchlife extender can be used, this is unnecessary in most cases and only increases the cost of the binder without a significant increase in benefits, and in some cases may even decrease the benchlife of the foundry mix.

Since the amount of benchlife extender used on the sand is a very small amount, typically from 0.001 to 0.05 weight percent based upon the weight of the aggregate, most typically 0.001 to 0.01 weight percent, for most situations it is preferable to mix the alkaline earth metal carbonate with a silicone compound to form an emulsion before adding it to the aggregate. This is an effective way of distributing the small amount of benchlife extender on the aggregate. Silicone compounds also improve the release of the foundry shapes made with the foundry mix.

Silicone compounds, which can be used in the foundry mix, typically are polydimethylsiloxanes, often trimethylsilyl terminated. Generally, they are sold commercially as fluids or emulsions (which contain water and a surfactant as well as the silicone compound). Examples of commercially available products which contain silicone compounds and are effective include DC 1101, DC 108, DC 24, DC 531. All of these mentioned products are emulsions except DC 531, and all are sold by Dow Corning Corporation. Examples of other commercially available silicone compounds are LE-460, AF-70 which are sold by Union Carbide and General Electric respectively. Typically the weight ratio of the benchlife extender to the silicone is from 0.50 to 5.0 weight percent based upon the total weight of the emulsion containing the benchlife extender.

In general, any salt of a strong inorganic or organic acid, preferably inorganic acid, can be used as the latent curing catalyst. Examples of salts of inorganic acids which can be used are ammonium chloride, ammonium sulfate, ammonium nitrate, aluminum perchlorate, cupric perchlorate, and chromic perchlorate. Examples of salts from organic acids include copper phenol sulfonate, aluminum toluene sulfonate, zinc phenol sulfonate, and copper tosylate. The amount of latent curing catalyst used is an effective catalytically amount to result in foundry shapes which can be handled without breaking. Generally, this amount is from 1 to 30 weight percent based upon the weight of the binder, typically from 5 to 20, preferably 10 to 20 weight percent.

Where the foundry shape must show a higher degree of resistance to water, it is preferable to use a silane. In such cases the water may come from moisture in the air or special processing conditions of the foundry shapes, such as immersion in a core wash.

Silanes which can be used generally have the structural formula:

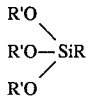

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. The aforesaid silane, when employed in concentrations of 0.1% to 2%, based on the phenolic binder and hardener.

Examples of some commercially available silanes are Dow Corning Z6040 and Union Carbide A-187 (gamma glycidoxy propyltrimethoxy silane); Union Carbide A-1100 (gamma aminopropyltriethoxy silane); Union Carbide A-1120 (N-beta(aminoethyl)-gamma-amino-propyltrimethoxy silane); and Union Carbide A-1160 (Ureido-silane).

It will be apparent to those skilled in the art that other additives such as release agents, solvents, etc. can be used and may be added to the binder composition, aggregate, or foundry mix.

The aggregate used to prepare the foundry mixes is that typically used in the foundry industry for such purposes or any aggregate that will work for such purposes. Generally, the aggregate will be sand which contains at least 70 percent by weight silica. Other suitable aggregate materials include zircon, olivine, alumina-silicate sand, chromite sand, and the like.

The acid demand value (ADV) of the aggregate generally ranges from 0–30, preferably from 0–10, most preferably 0–5. Usually, aggregates with a lower ADV value will be more likely to need a benchlife extender, and more of the benchlife extender. Preferably used as the aggregate is Lake sand. Generally, the particle size of the aggregate is such that at least 80 percent by weight of the aggregate has an average particle size between 40 and 150 mesh (Tyler Screen Mesh).

Although it is possible to mix the components of the binder system with the aggregate in various sequences, it is preferred to add the latent acid curing acid catalyst to the aggregate and mix it with the aggregate before adding the thermosetting resin and the benchlife extender. It is also preferred to mix the thermosetting resin with the aggregate before adding the benchlife extender. It also preferred to store the foundry mixes in covered, i.e. in enclosed containers, until the foundry mixed is ready to use. It is anticipated that the foundry mix will not always be covered, but it is preferable to keep it covered as much as possible when the foundry mix is not in use.

Curing is accomplished by heating the shaped foundry mix in a convection oven, a microwave oven, or by means of another heat source. Generally, however, curing is accomplished by injecting the foundry mix into a core box which has been heated to a temperature sufficient to cure the foundry mix and produce a workable foundry shape. Generally, the temperature needed to cure the foundry mix is from 180° C. to 300° C., preferably from 230° C. to 260° C. A workable foundry shape is one which can be handled without breaking. Generally, the foundry mix resides in the core box from 15 seconds to 120 seconds, usually from 30 seconds to 90 seconds to produce a workable foundry shape.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

EXAMPLES

The examples which follow will illustrate specific embodiments of the invention. They are not intended to imply that the invention is limited to these embodiments. The temperatures in the examples are in degrees Centigrade and the parts are parts by weight unless otherwise specified.

In Examples 1–4, a phenol-formaldehyde-urea condensate is sold under the trademark CHEM-REZ®57-974G binder, commercially available from Ashland Chemical, Inc., is used as the resin. CHEM-REZ 57-974G is a copolymer of urea-formaldehyde and phenol-formaldehyde condensates having a solids content of about 70% percent, a viscosity of about 400 centipoise at 25° C., and a free formaldehyde content of about 2.5%.

Foundry mixes are prepared by first adding CHEM-REZ® 1595 GI catalyst (an aqueous solution of ammonium nitrate which is about 19 percent active based upon the total solution) sold by Ashland Chemical, Inc. as the latent acid catalyst. Then the binder is added in an amount of 1.8 weight percent based upon the weight of the sand. Next the benchlife extender is added in an amount of 6 weight percent based upon the weight of the binder. In all of the examples Manley 1L5W sand is used. The foundry mixes are stored in covered containers.

The resulting foundry mixes are forced by air blowing the mix into a standard AFS core box (dog bone shape) which had been heated to a temperature of 232° C. The tensile strengths (in psi) for various samples are measured after being taken from the core box after a dwell time of 30 seconds. The hot tensile measurements are taken within 10 seconds after removing the shapes from the corebox. The cold tensile strength is measured at least 1 hour after removing the shapes from the corebox and storing them at a relative humidity of approximately 50 percent. Tensile measurements are also made 5 hours after being taken from the corebox and 24 hours after being taken from the corebox.

EXAMPLES 1–4

Controls 1 and 2 and Examples 1–4 illustrate the effect of adding an alkaline carbonate or an alkaline earth metal oxide to a foundry mix which is aged several hours before using. The tensile strength is first shown for a covered foundry mix without a benchlife extender (CTRL 1). Then the tensile strength is shown for an uncovered foundry mix (CTRL 2). In both cases, the bench life is not adequate.

In Examples 1–4, the foundry mixes are all covered. In Example 1, Gamma Fil 90, an aqueous slurry containing 75% by weight of calcium carbonate (based upon the weight of the aqueous slurry) is the benchlife extender mixed with the aggregate. In Example 2, CHEM-REZ® BLE benchlife extender sold by Ashland Chemical, Inc., a suspension of calcium carbonate (1.25% by weight based upon the weight of the emulsion) having a particle size of about 3 microns in a silicone emulsion sold by Ashland Chemical, Inc., is the benchlife extender mixed with the aggregate. In Example 3, an emulsion of calcium oxide (1.25% by weight based upon the weight of the emulsion) in silicone, is the benchlife extender mixed with the aggregate, while in Example 4 an emulsion of magnesium oxide (1.25% by weight based upon the weight of the emulsion) in silicone is the benchlife extender mixed with the aggregate.

The results of Example 1–4 show that the use of a benchlife extender in the foundry mixes tested increases the tensile strength of cores made with the aged foundry mix, particularly when the foundry mix is covered.

(c) a catalytically effective amount of a latent acid catalyst; and (d) an effective benchlife extending amount of a compound selected from the group consisting of an alkaline earth metal carbonate, alkaline earth metal oxide, or mixtures thereof.

2. The foundry mix of claim 1 wherein the thermosetting resin is a phenol-formaldehyde-urea condensate.

3. The foundry mix of claim 2 wherein the benchlife extender is calcium carbonate.

4. The foundry mix of claim 3 wherein the calcium carbonate is dispersed in a silicone compound.

5. The foundry mix of claim 4 wherein the latent acid catalyst is selected from the group consisting of ammonium nitrate, ammonium sulfate, and ammonium chloride.

6. The foundry mix of claim 4 wherein the amount of thermosetting resin in the binder system is from 1 to 10 weight percent based upon the weight of the aggregate and the particle size of the benchlife extender is from 1 micron to 10 microns.

7. The foundry mix of claim 4 wherein the weight ratio of calcium carbonate is from 1 weight percent to 15 weight percent based upon the weight percent of the aggregate.

8. A process for preparing a workable foundry shape comprising:

(a) mixing a foundry aggregate with a bonding amount of up to about 10% by weight, based upon the weight of the aggregate, of a binder composition comprising:

(1) a thermosetting resin;

(2) a catalytically effective amount of an acid catalyst; and (3) an benchlife extending amount of an alkaline earth metal carbonate, alkaline earth metal oxide, or mixtures thereof; and (b) introducing the foundry mix obtained from step (a) into a heated core box at a temperature sufficient to cure said mix;

TABLE I

| | ADDITIVE | TENSILE PROPERTIES | | | | | | | | |
|---|---|---|---|---|---|---|---|---|---|---|
| | Based on Binder | NEW MIX | | 3 HR BENCH | | 5 HR BENCH | | 24 HR BENCH | | |
| EXAMPLE | (BOB) | IMM | 1 HR | IMM | 1 HR | IMM | 1 HR | IMM | 1 HR | Remarks |
| CTRL 1 | None | 89 | 320 | 81 | 325 | 71 | 369 | | | Mix covered. Could not blow full bones after 24 hours. |
| CTRL 2 | None | 47 | 205 | | | | | | | Mix uncovered. Could not blow full bones after 3 hours. |
| 1 | 2.8% Gamma Fil 90 (aqueous slurry of $CaCO_3$) BOB | 52 | 153 | 41 | 173 | 41 | 174 | 27 | 149 | Mix covered. |
| 2 | 6% BLE GI, (emulsion of $CaCO_3$) BOB | 72 | 368 | 73 | 385 | 77 | 385 | 45 | 354 | Mix covered. |
| 3 | 6% BLE GI, (made with CaO) BOB | 73 | 274 | 95 | 405 | 88 | 468 | 63 | 330 | Mix covered. |
| 4 | 6% BLE GI, (made with MgO) BOB | 88 | 389 | 86 | 462 | 96 | 447 | 81 | 458 | Mix covered. |

We claim:

1. A hot-box foundry mix comprising:

(a) a foundry aggregate;

(b) a thermosetting resin;

(c) allowing the foundry mix to harden into a workable foundry shape; and (d) thereafter removing the workable foundry shape of step (c) from the corebox and allowing it to further cure, thereby obtaining a hard, solid, cured foundry shape.

9. The process of claim 8 wherein the foundry mix prepared in step (a) is stored in an enclosed container until it is used.

10. The process of claim 9 wherein the thermosetting resin is a phenol-formaldehyde-urea condensate.

11. The process of claim 10 wherein the benchlife extender is calcium carbonate.

12. The process of claim 11 wherein the calcium carbonate is dispersed in a silicone.

13. The process of claim 12 wherein the latent acid catalyst is hydrochloric acid or sulfuric acid.

14. The process of claim 13 wherein the amount of thermosetting resin in the binder system is from 1 to 10 weight percent based upon the weight of the aggregate and the particle size of the benchlife extender is from 1 micron to 10 microns.

15. The process of claim 14 wherein the weight ratio of calcium carbonate is from 1 weight percent to 15 weight percent base upon the weight percent of the aggregate.

* * * * *